US007658646B2

(12) United States Patent
Yuan et al.

(10) Patent No.: US 7,658,646 B2
(45) Date of Patent: Feb. 9, 2010

(54) HIGH-SPEED ELECTRICAL CONNECTOR WITH RAISED SUPPORTING WALL

(75) Inventors: Wei Yuan, ShenZhen (CN); Yu-San Hsiao, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/221,622

(22) Filed: Aug. 4, 2008

(65) Prior Publication Data

US 2009/0035966 A1 Feb. 5, 2009

(30) Foreign Application Priority Data

Aug. 3, 2007 (CN) ..... 2007 2 0041178

(51) Int. Cl.
*H01R 13/648* (2006.01)

(52) U.S. Cl. ..... 439/607.4

(58) Field of Classification Search ..... 439/607.23, 439/607.25, 607.35, 607.36, 607.37, 607.4
See application file for complete search history.

(56) References Cited

U.S. PATENT DOCUMENTS 7,473,133 B1 * 1/2009 Zhang ..... 439/607

FOREIGN PATENT DOCUMENTS

CN 2667736 12/2004

* cited by examiner

*Primary Examiner*—Ross N Gushi
(74) *Attorney, Agent, or Firm*—Wei Te Chung; Andrew C. Cheng; Ming Chieh Chang

(57) ABSTRACT

An electrical connector assembly includes an insulative housing (10) having a forward mating port (100) in a suspension manner, a plurality of recesses (112), arranged in a matrix manner, formed in the housing (10) under the mating port (100) so as to form a plurality of corresponding partitions (111) among the recesses (112) for support of the mating port (10). The matrix array of recesses (112) is arranged to strengthen the rigid of the housing (10) under the mating port (100) so as to prevent the deformation of the mating port (100), which is influenced from the insert force under a condition when the electrical connector mates with a complementary connector.

11 Claims, 3 Drawing Sheets

HIGH-SPEED ELECTRICAL CONNECTOR WITH RAISED SUPPORTING WALL

CROSS-REFERENCE TO RELATED APPLICATIONS

This application is related to U.S. patent application filed on Jul. 5, 2007 with a Ser. No. 11/825,266, and entitled "ELECTRICAL CONNECTOR", which has assigned to the same assignee with this application, and the content of which is hereby incorporated by reference.

BACKGROUND OF THE INVENTION

1. Field of the Invention

The present invention relates to the art of electrical connectors, and more particularly to an electrical connector used for high-speed transmission and having raised supporting wall thereof.

2. Description of the Related Art

Chinese Pat. Issue. No. 2667736 disclosed a related electrical connector used for high-speed transmission and including an insulative housing having a forward mating port in a suspension manner with a distance away from a mounting face, which is mounted onto a printed circuit board. The forward mating port is adapted to mate with a complementary connector. The problem, however, with the above electrical connector, is that the forward mating port is apt to be deformed by the insert force, which is generated under a condition when the connector mated with the complementary connector. That is because the mating port is disposed in the suspension manner and spaced far away from the mounting face of the housing. Therefore, there is a need to provide a new connector to resolve the above-mentioned problem.

In addition, the EMI issue is one most important thing for signal transmission of electrical connectors particularly used for high-speed transmission. To improve the EMI effect, designers usually adopt a conductive shell to cover housing and contacts to depress EMI. These solutions are more important for connectors used in external circumstances. As disclosed by U.S. Pat. Nos. 7,052,321 and 6,758,685, conductive shells are adopted to enclose housings and contacts to improve EMI effect. Particularly, rear walls of the conductive shells each define a cutout at lower ends thereof to expose tail portions of the contacts to be soldered on corresponding PCBs. However, it is right the cutouts cause the leakage of noises which affects the EMI effect. It is desired to have an electrical connector with improved conductive shell to improve EMI effect.

SUMMARY OF THE INVENTION

An electrical connector assembly according to an embodiment of the present invention includes an insulative housing having a forward mating port in a suspension manner, a plurality of recesses, arranged in a matrix manner, formed in the housing under the mating port so as to form a plurality of corresponding partitions among the recesses for support of the mating port, a plurality of passageways formed in the housing and communicating with the mating port, a plurality of ribs formed on a rear face of the housing in alignment with the corresponding passageways respectively so as to form a plurality of channels each between every adjacent two ribs, a plurality of contacts disposed in the housing, each of said contacts defining a vertical retention section and a right angle tail below the vertical retention section for surface mounting on a corresponding printed circuit board on which the housing is seated, and a metallic shell having top plate, two side plates, and a rear plate respectively covering a top face, two side faces, the rear face of the housing. The matrix array of recesses is arranged to strengthen the rigid of the housing, functioning as strengthened and raised supporting wall, under the mating port so as to prevent the deformation of the mating port, which is influenced from the insert force under a condition when the electrical connector mates with a complementary connector.

Other features and advantages of the present invention will become more apparent to those skilled in the art upon examination of the following drawings and detailed description of preferred embodiments, in which:

DETAILED DESCRIPTION OF PREFERRED EMBODIMENT

Figure 1:
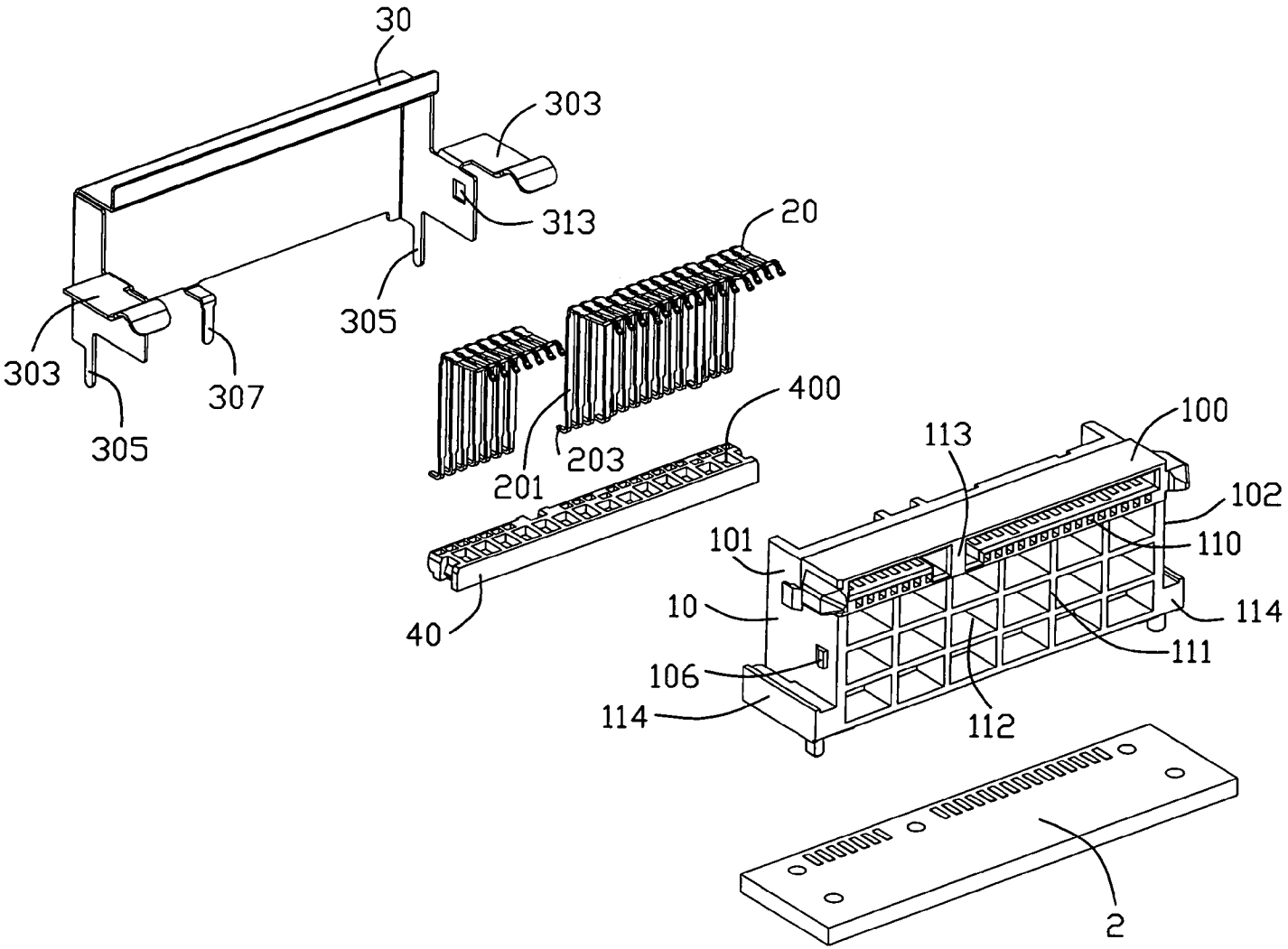
FIG. 1 is an exploded, perspective view of an electrical connector assembly according to an embodiment of the present invention.
Figure 2:
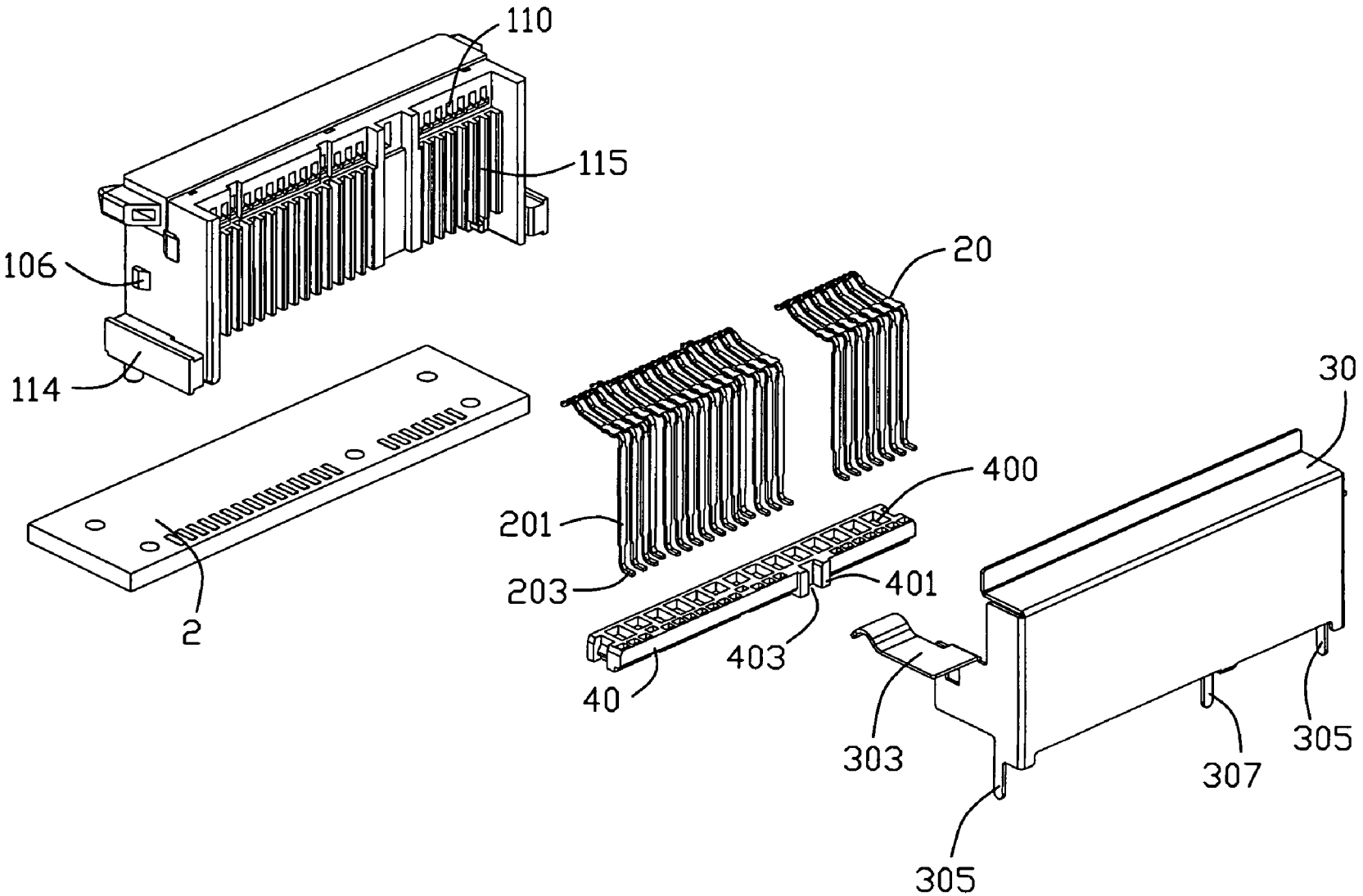
FIG. 2 is another exploded, perspective view of the electrical connector assembly of FIG. 1, viewed from another aspect.
Figure 3:
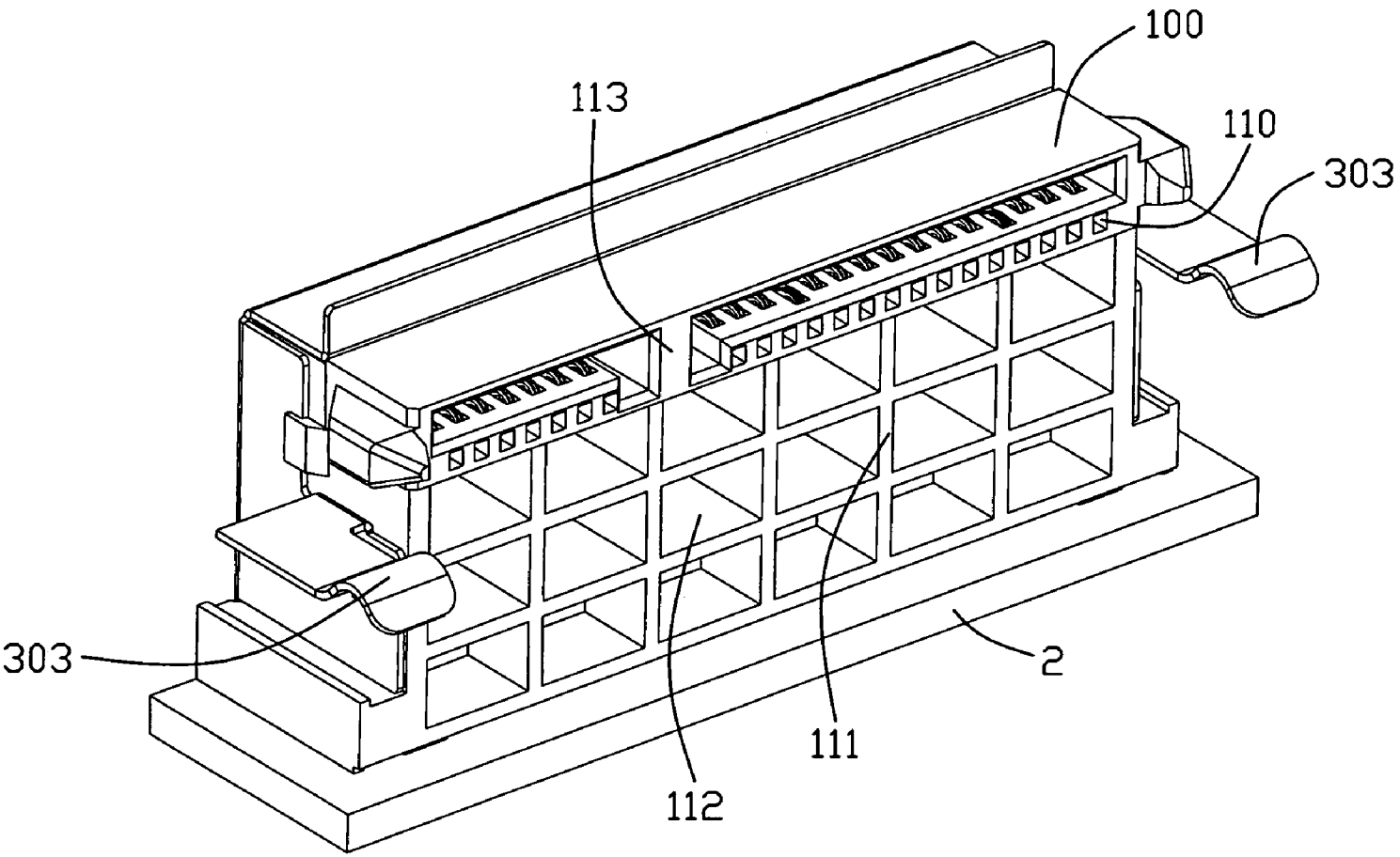
FIG. 3 is an assembled, perspective view of an electrical connector assembly according to an embodiment of the present invention.

Referring to FIGS. 1 to 3, an electrical connector assembly mounted onto a printed circuit board 2 according to an embodiment of the present invention is shown to have an insulative housing 10 including a forwardly protruding mating port 100 in suspension manner, a plurality of passageways 110 formed in the housing 10 and communicating with the mating port 100, a plurality of contacts 20 disposed in the housing 10 with each defining a vertical retention section 201 and a right angle tail 203 below the vertical retention section 201 for surface mounting on the printed circuit board 2 on which the housing 10 is seated, a spacer 40 assembled to the housing 10 and defining a plurality of through holes 400 in a vertical section for tails 203 of the contacts 20 to extend therethrough, and a metallic shell 30 having a top plate, first and second side plates and a rear plate respectively covering a top face, two side faces and a rear face of the housing 10.

The mating port 100 is divided by a division or a partition wall 113 into a long section and a short section, with the division 113 located much closer to a first side wall 101 of the mating port 100 than a second side wall 102 of the mating port 100. The metallic shell 30 includes solder foots 305 and 307 respectively extending from rear edges of the side plates and the rear plate, with the rear solder foot 307 of the rear plate extending forwardly with a distance from the rear edge of the rear plate and essentially aligned with the division 113 in a vertical direction. Note, there is no other solder foot extending from the rear edge of the rear plate except for that rear solder foot 307 of the rear plate, which is essentially aligned with the division 113 in the vertical direction. The rear edge of the rear plate is cut or arranged such that the tails 203 of the contacts 20, from a back view of the housing, can be viewed between every two solder foot 305 and 307. This rear solder foot 307 of the rear plate is set to improve EMI effect. The spacer 40 also forms a protrusion 401 aligned with the division 113 of the mating port 100 in the vertical direction and defines a slit 403 therethrough in the vertical direction, and the rear solder foot 307 of the rear plate extends through the slit 403 in the vertical direction. In addition, the housing 10 includes a pair of abutments 114 formed on opposite sides thereof, and the shell 30 is formed with a pair of wings 303, in correspondence with the abutments 114, with bottom edges of the side plates (see FIG. 3) seated upon the corresponding abutments 114 so as to assemble the shell 30 onto the housing 10. Each side plate has a retaining recess 313 for mating with a tab 106 on the corresponding side wall of the housing 10 to assist in the assembly of the shell 30 onto the housing 10.

A plurality of recesses 112, arranged in a matrix manner, is formed in the housing 10 under the mating port 100 so as to form a plurality of corresponding partitions 111 among the recesses 112 for support of the mating port 100. The matrix array of recesses 112 is arranged to strengthen the rigid of the housing 10, functioning as strengthened and raised supporting wall, under the mating port 100 so as to prevent the deformation of the mating port 100, which is influenced from the insert force under a condition when the electrical connector mates with a complementary connector. A plurality of ribs 115 is formed on a rear face of the housing 10 in alignment with the corresponding passageways 110 respectively so as to form a plurality of channels each between every adjacent two ribs 115. The vertical section 201 of each of the contacts 20 is snugly received in the corresponding channel.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. An electrical connector assembly comprising:

an insulative housing having a forward mating port elevated away from a mounting face;

a plurality of recesses, arranged in a matrix manner, formed in the housing under the mating port so as to form a plurality of corresponding partitions among the recesses for support of the mating port;

a plurality of passageways formed in the housing and communicating with the mating port;

a plurality of ribs formed on a rear face of the housing in alignment with the corresponding passageways respectively so as to form a plurality of channels each between every adjacent two ribs;

a plurality of contacts disposed in the housing, each of said contacts defining a vertical retention section and a right angle tail below the vertical retention section for surface mounting on a corresponding printed circuit board on which the housing is seated;

a metallic shell having top plate, two side plates, and a rear plate respectively covering a top face, two side faces, the rear face of the housing; and wherein the housing includes a pair of abutments formed on opposite sides thereof, and the shell is formed with a pair of wings seated upon the corresponding abutments so as to assemble the shell onto the housing.

2. The electrical connector assembly of claim 1, wherein the mating port is divided by a partition wall into a long section and a short section, the partition wall located much closer to a first side wall of the mating port than a second side wall of the mating port.

3. The electrical connector assembly of claim 2, wherein the rear plate of a metallic shell is formed with a rear solder foot essentially aligned with the partition wall in a vertical direction.

4. The electrical connector assembly of claim 1, wherein the side plates of the shell are formed with side solder foots respectively, the rear plate having a rear solder foot extending forwardly with a distance from a rear edge of the rear plate.

5. The electrical connector assembly of claim 1, further comprising a spacer assembled to the housing and defining a plurality of holes therethrough in a vertical direction, the tail extending through the corresponding hole of the spacer.

6. The electrical connector assembly of claim 2, further comprising a spacer assembled to the housing, the spacer forming a protrusion aligned with the partition wall of the mating port in a vertical direction and defining a slit therethrough in said vertical direction, and a solder foot of the rear plate extending through the slit in said vertical direction.

7. An electrical connector assembly, comprising:

a printed circuit board defining through holes therein;

an electrical connector mounted upon the printed circuit board, said connector including:

an insulative housing defining a raised forwardly mating portion with a pair of guiding posts at two lengthwise opposite ends thereof, and a bottom portion with a pair of abutments at two lengthwise opposite ends thereof, where a pair of mounting posts downwardly extend into the corresponding through holes, respectively;

a plurality of passageways defined in the housing and extending into the mating portion;

a plurality of contacts disposed in the corresponding passageways, respectively, with mating sections in the mating portion;

a metallic shell covering said housing and including a pair of horizontally extending wings extending on a pair of side plates thereof under a condition that said pair of wings are respectively located vertically between the pair of corresponding guiding posts and the pair of abutments.

8. The electrical connector assembly as claimed in claim 7, wherein said mounting posts are unitarily formed with the shell.

9. The electrical connector assembly as claimed in claim 7, wherein said mounting posts are unitarily formed with the housing.

10. The electrical connector assembly as claimed in claim 9, wherein said shell further includes another pair of unitarily formed mounting posts extending through the corresponding through holes in the printed circuit board.

11. The electrical connector assembly as claimed in claim 10, wherein said another pair of mounting posts further extend through corresponding through slits in the corresponding pair of abutments before reaching the printed circuit board.

* * * * *